US012575676B2

(12) United States Patent
Beck et al.

(10) Patent No.: US 12,575,676 B2
(45) Date of Patent: Mar. 17, 2026

(54) SHELVING UNIT TIE BAR

(71) Applicant: LL&T INTERNATIONAL, LLC, Knoxville, TN (US)

(72) Inventors: Todd Beck, St. Charles, MO (US); Lam Lam Ly, Ho Chi Min City (VN)

(73) Assignee: LL&T International, LLC, Knoxville, TN (US)

( * ) Notice: Subject to any disclaimer, the term of this patent is extended or adjusted under 35 U.S.C. 154(b) by 0 days.

(21) Appl. No.: 17/992,260

(22) Filed: Nov. 22, 2022

(65) Prior Publication Data

US 2023/0189993 A1 Jun. 22, 2023

Related U.S. Application Data

(63) Continuation of application No. 17/645,105, filed on Dec. 20, 2021, now Pat. No. 11,602,221.

(51) Int. Cl.
*A47B 96/14* (2006.01)
*A47B 57/34* (2006.01)
(Continued)

(52) U.S. Cl.
CPC ..... *A47B 96/14* (2013.01); *A47B 57/34* (2013.01); *A47B 57/00* (2013.01); *A47B 57/40* (2013.01)

(58) Field of Classification Search
CPC ..... A47B 96/14; A47B 57/34; A47B 57/00; A47B 57/40; A47B 57/06; A47B 57/08;
(Continued)

(56) References Cited

U.S. PATENT DOCUMENTS 2,815,130 A * 12/1957 Franks ..... A47B 57/402 211/187
2,918,176 A * 12/1959 Bell ..... A47B 47/027 211/187
(Continued)

FOREIGN PATENT DOCUMENTS

CN 207803807 U 9/2018
DE 8802386 U1 4/1988
(Continued)

OTHER PUBLICATIONS

International Search Report and Written Opinion received for PCT Patent Application No. PCT/US2022/053329, mailed on Apr. 26, 2023, 8 pages.
(Continued)

*Primary Examiner* — Devin K Barnett
(74) *Attorney, Agent, or Firm* — Shook, Hardy & Bacon L.L.P.

(57) ABSTRACT

The technology described herein includes a four-column shelving unit. One or more improved tie bars run between the front and rear shelf-support beams. The one or more tie bars are installed perpendicular to the shelf-support beams. The improved tie bar may take the overall form of a V-channel with a novel tri-notch connection on either end. The tri-notch connection allows the tie bar to connect with a front shelf-support beam on one end and a back shelf-support beam on the other end. The tri-notch connection includes two bottom notches and a top notch. The top notch may form a gap in the V-channel that allows the end of the tie bar to slip under a shelf-support flange on a shelf-support beam during installation. The two bottom notches are sized and shaped to receive an upward facing retention flange located on the bottom flange of the shelf-support beam.

20 Claims, 4 Drawing Sheets

(51) Int. Cl.
*A47B 57/00* (2006.01)
*A47B 57/40* (2006.01)

(58) Field of Classification Search
CPC ..... A47B 57/16; A47B 57/20; A47B 57/50; A47B 57/402; A47B 57/487; A47B 96/1408
See application file for complete search history.

(56) References Cited

U.S. PATENT DOCUMENTS 2,937,767 A * 5/1960 Butler ..... A47B 47/021 211/187
2,960,238 A * 11/1960 Russell ..... A47B 47/027 211/134
3,013,644 A * 12/1961 Smith ..... E04B 9/32 52/666
3,018,862 A * 1/1962 Litteral ..... A47B 96/021 211/186
3,285,428 A * 11/1966 Scheck ..... A47B 57/06 52/666
3,297,374 A * 1/1967 Radek ..... A47F 5/103 312/334.47
3,302,800 A * 2/1967 Zdanowski ..... B65D 85/185 206/291
3,812,636 A * 5/1974 Albrecht ..... E04D 3/30 52/630
3,918,234 A * 11/1975 Weissman ..... E04B 9/006 52/645
4,078,664 A * 3/1978 McConnell ..... A47B 96/00 211/187
4,558,647 A * 12/1985 Petersen ..... A47B 57/14 108/107
4,665,838 A * 5/1987 Minshall ..... A47B 47/021 211/186
4,909,402 A * 3/1990 Highsmith ..... A47B 96/02 211/184
4,955,490 A * 9/1990 Schafer ..... A47B 96/02 211/187
5,011,031 A * 4/1991 Konstant ..... A47B 47/027 211/192
5,628,415 A * 5/1997 Mulholland ..... A47B 47/027 211/186
5,647,492 A * 7/1997 Fillios ..... A47G 25/0692 211/105.1
5,845,794 A * 12/1998 Highsmith ..... A47F 5/13 211/151
6,039,192 A * 3/2000 Hollander ..... A47B 96/021 211/186
6,105,798 A * 8/2000 Gruber ..... B65G 1/02 211/151
D439,443 S * 3/2001 Nadon ..... D6/675.1
6,332,547 B1 * 12/2001 Shaw ..... A47F 1/12 211/59.2
7,779,593 B2 * 8/2010 Jahn ..... E04B 9/068 52/506.07
8,443,992 B2 * 5/2013 Lawson ..... A47B 47/024 211/187
9,215,926 B1 * 12/2015 Offerman ..... A47B 47/02
9,215,931 B1 * 12/2015 Offerman ..... A47B 96/024
9,375,102 B2 * 6/2016 Troyner ..... A47F 5/01
9,376,809 B1 * 6/2016 Trover ..... E04C 2/427
9,386,855 B2 * 7/2016 Sabounjian ..... A47B 96/14
9,854,906 B1 * 1/2018 Ke ..... A47B 47/0083
10,299,594 B2 * 5/2019 Liss ..... A47B 47/027
10,806,257 B1 * 10/2020 Liu ..... A47B 47/024
11,026,509 B2 * 6/2021 Walker ..... A47B 47/0083
11,046,512 B2 * 6/2021 Vermeulen ..... B65G 1/026
11,098,474 B2 * 8/2021 Lehane ..... E04B 9/30
11,369,198 B2 * 6/2022 Sytsma ..... A47B 96/021
11,419,413 B2 * 8/2022 Iellimo ..... A47B 96/02
2004/0251224 A1 * 12/2004 Kircher ..... A47B 47/02 211/153
2005/0103733 A1 * 5/2005 Saltzberg ..... A47B 96/00 211/187
2006/0060550 A1 * 3/2006 Cross ..... A47B 96/021 211/134
2006/0086683 A1 * 4/2006 Skulnik ..... A47B 96/021 211/183
2006/0163185 A1 * 7/2006 Konstant ..... A47F 5/01 211/189
2010/0084354 A1 * 4/2010 Eustace ..... A47F 5/00 211/183
2012/0000871 A1 * 1/2012 Troyner ..... A47B 47/021 211/134
2014/0116973 A1 * 5/2014 Buckley ..... A47F 5/00 29/525.01
2015/0090683 A1 * 4/2015 Sabounjian ..... A47B 96/14 211/186
2015/0359330 A1 * 12/2015 Offerman ..... A47B 47/03 211/186
2016/0185011 A1 * 6/2016 Hall ..... B27B 17/12 83/820
2018/0066691 A1 * 3/2018 Matsumoto ..... H05K 7/18
2018/0279782 A1 10/2018 Liss et al.
2019/0328134 A1 * 10/2019 Walker ..... A47B 96/1408
2023/0218083 A1 * 7/2023 Straatsma ..... A47B 96/1441 211/134
2023/0270248 A1 * 8/2023 Hanlon ..... A47B 47/0083 211/187

FOREIGN PATENT DOCUMENTS

DE 29604984 U1 5/1996
DE 102021107910 A1 9/2022
EP 1129644 A1 * 9/2001 ..... A47B 57/50
WO 2018/107267 A1 6/2018

OTHER PUBLICATIONS

Notice of Allowance dated Nov. 14, 2022 in U.S. Appl. No. 17/645,105, 14 pages.
Office Action received for Canadian Application No. 3171028, mailed on Oct. 30, 2023, 5 pages.
Office Action received for Canadian Patent Application No. 3171028, mailed on Jun. 18, 2025, 8 pages.

* cited by examiner

SHELVING UNIT TIE BAR

CROSS-REFERENCE TO RELATED APPLICATIONS

This application is continuation of U.S. patent application Ser. No. 17/645,105, filed on Dec. 20, 2021, entitled "SHELVING UNIT TIE BAR," the entirety of which is hereby incorporated by reference.

BACKGROUND

Shelving units comprising vertical corner columns, horizontal shelf beams, tie bars, and shelves supported by the beams are known. Existing shelving units are designed to withstand heavy loads without significant deformation. Existing shelving units are also designed to be relatively lightweight and easy to assemble and disassemble. The materials of construction, component size, and component design work together to maximize load capacity, lower the unit weight, and decrease the assembly difficulty. These design factors are often in tension with each other. For example, a lighter unit may be achieved by using thinner structural members. But, in general, the use of thinner members, assuming the same material of construction (e.g., steel or aluminum), may decrease the maximum load capacity. Increasing the load capacity may also decrease the ease of assembly, because, if nothing else, heavier components may be more difficult to manipulate during assembly and could even require mechanical assistance, such as rigging. In addition, heavier components may require more complex mechanisms to connect the beams, columns, shelves and bracing.

Assembly difficult may be measured in the amount of time needed to assemble a unit, amount of people needed to assemble a unit, tools needed to assemble the unit and mechanical skill needed to assemble. An increased precision of fit and overall alignment precision needed to connect different pieces may increase assembly difficulty. It is desirable to improve ease of assembly, by decreasing the tools needed, mechanical skill needed, and time taken to assemble a unit. It is also desirable to increase the ease of assembly by providing components that have greater alignment leeway during assembly. An objective of this invention is to provide a shelving unit that may be shipped in a disassembled state and easily assembled into a structurally sound shelving unit.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

The technology described herein includes a four-column shelving unit with front and rear shelf-support beams running between two front columns and two back columns. One or more improved tie bars run between the front and rear shelf-support beams. The one or more horizontal tie bars are installed perpendicular to the shelf-support beams. The one or more tie bars may be installed at different intervals along the shelf beams. The improved tie bar of the present invention improves upon past tie bars by providing a more flexible installation location. Unlike existing tie bars, the tie bar of the present invention is not limited to installation at any specific location on the shelf-support beam. The tie bar of the present invention also provides a tool free installation that may be performed by a single person.

The improved tie bar may take the overall form of a V-channel with a novel tri-notch connection on either end. The tri-notch connection allows the tie bar to connect with a front shelf-support beam on one end and a back shelf-support beam on the other end. When installed between support beams, the point of the V-channel is facing upward away from the floor. The open end of the V-channel faces downward. Rather than coming to a sharp point, the V-channel may have a flat bottom for a shelf medium to rest upon. The width of the flat bottom may be substantially smaller than the width of the opening of the V-channel. The tie bar may include outward facing flanges on the bottom-end (open end) of each leg of the V-channel. The outward facing flanges may be substantially parallel to the base of the V-channel and the floor upon which the shelving unit is installed.

The tie bar connects to the support beams through novel tri-notch connections located at either end of the tie bar. The tri-notch connection includes two bottom notches and a top notch. The two bottom notches may be U-shaped and may alternatively be described as slots. The top notch may form a gap in the V-channel that allows the end of the tie bar to slip under a shelf-support flange on a shelf-support beam during installation. The two bottom notches are sized and shaped to receive an upward facing retention flange located on the bottom flange of the shelf-support beam. A bottom notch is located in each leg of the V-channel. The bottom notches are formed at the same distance from the end of the tie-bar in each leg. The outward facing flanges on the legs of tie bar may rest on the upward facing top of the bottom flange of the shelf-support beam. When installed, the upward facing base of the tie-bar may have the same elevation as the shelf-support flange. This allows the shelf medium (e.g., grating, steel plate) to lie flat across the tie bar and shelf-support flange. If the tie bar did not have the same elevation as the shelf-support flange, then the shelf medium would dip down from the support flange elevation to meet the tie bar or slope upward towards the tie bar and away from the support flange.

An advantage of the technology described herein that the tie bar can be installed at any point along the horizontal shelf-support beam. Accordingly, openings in the horizontal shelf-support beam that mate with the tie bar and limit the installation of the tie bar to locations on the beam having the openings are inconsistent with the technology described herein. Accordingly, an improvement of the technology described herein is a horizontal shelf-support beam without openings that limit the installation location of the tie bar. The tri-notch system described herein enables a secure installation of the tie bar at any location along the horizontal shelf-support beam.

BRIEF DESCRIPTION OF THE DRAWINGS

The technology described herein is illustrated by way of example and not limitation in the accompanying figures in which like reference numerals indicate similar elements and in which.

DETAILED DESCRIPTION

Figure 1:
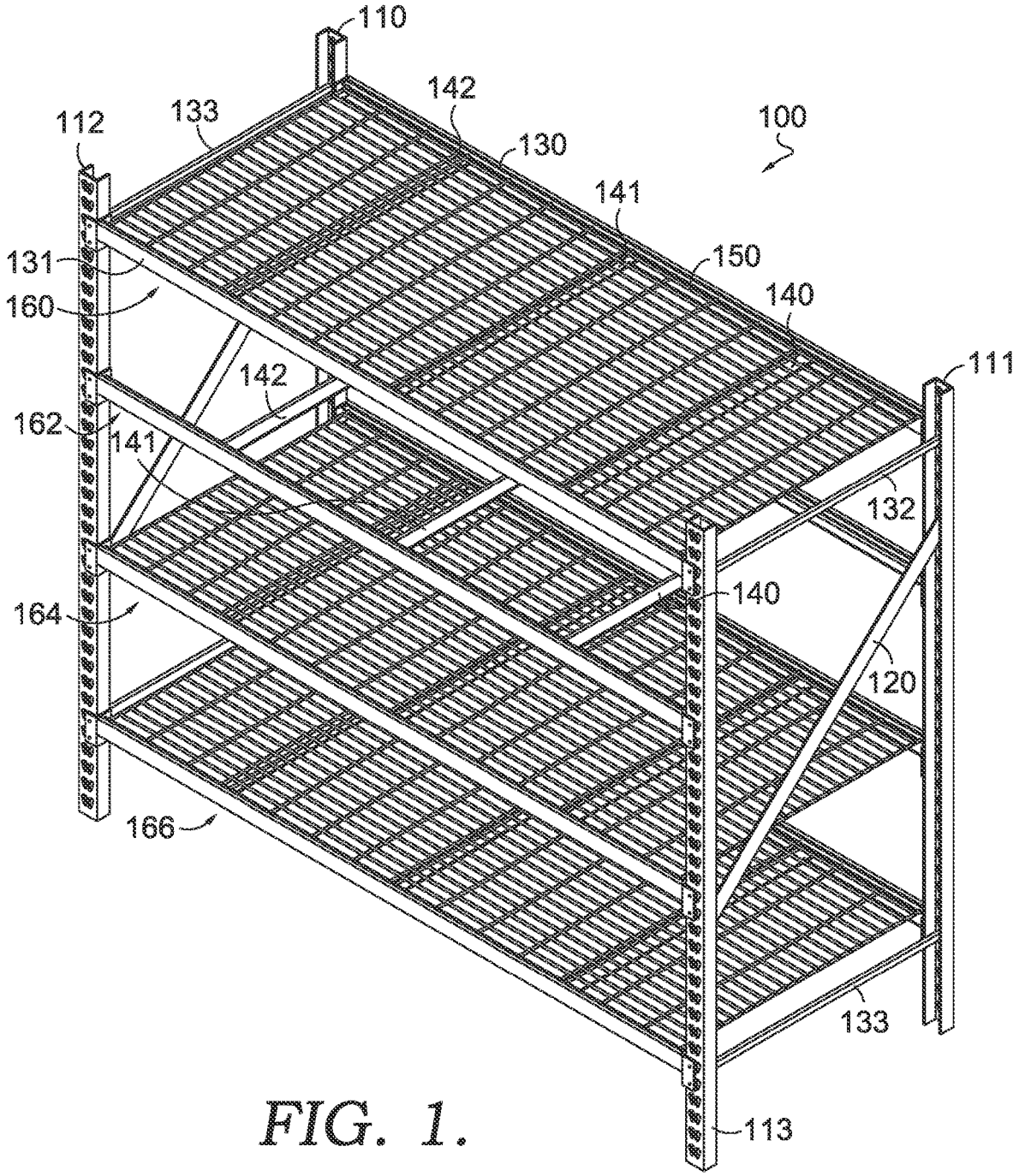
FIG. 1 is a perspective view of a shelving unit, in accordance with aspects of the present disclosure.

The various technologies described herein are set forth with sufficient specificity to meet statutory requirements. However, the description itself is not intended to limit the scope of this patent. Rather, the inventors have contemplated that the claimed subject matter might also be embodied in other ways, to include different steps or combinations of steps similar to the ones described in this document, in conjunction with other present or future technologies. Moreover, although the terms "step" and/or "block" may be used herein to connote different elements of methods employed, the terms should not be interpreted as implying any particular order among or between various steps herein disclosed unless and except when the order of individual steps is explicitly described.

The technology described herein includes a four-column shelving unit with front and rear shelf-support beams running between two front columns and two back columns. One or more improved tie bars run horizontally between the front and rear shelf-support beams. The one or more tie bars are installed perpendicular to the shelf-support beams. The one or more tie bars may be installed at different intervals along the shelf beams, such as every foot, every 18 inches, every two feet, and the like. The improved tie bar of the present invention improves upon past tie bars by providing a more flexible installation location. Unlike existing tie bars, the tie bar of the present invention is not limited to installation at any specific location on the shelf-support beam. The tie bar of the present invention also provides a tool free installation that may be performed by a single person.

The improved tie bar may take the overall form of a V-channel with a novel tri-notch connection on either end. The tri-notch connection allows the tie bar to connect with a front shelf-support beam on one end and a back shelf-support beam on the other end. The terms front and back describe the shelving unit from the perspective a person viewing the assembled shelving unit. The terms front and back may be relative as the shelving unit may be reversible because there may be not visible or functional different between the front side and back side of the shelving unit.

When installed between support beams, the point of the V-channel is facing upward away from the floor. The open end of the V-channel faces downward. Rather than coming to a sharp point, the V-channel may have a flat bottom for a shelf surface to rest upon. The width of the flat bottom may be substantially smaller than the width of the opening of the V-channel. As used herein, a V-channel comprises two sides of substantially flat structural material (e.g., steel, aluminum) that come together at one end, either directly, or indirectly through use of a base member. The tie bar may include outward facing flanges on the bottom-end (open end) of each side of the V-channel. The outward facing flanges may be substantially parallel to the base of the V-channel and the floor upon which the shelving unit is installed.

The tie bar connects to the front shelf-support beam and the back shelf-support beam. The ends of the tie bar may include the same features allowing installation of the tie bar in either direction. Nevertheless, for the sake of description, one end of the tie bar is described herein as the front end because it connects to the front support beam and the other is designated as the back end because it connects to the back support beam.

The tie bar connects to the support beams through a novel tri-notch connection. The tri-notch connection includes two bottom notches and a top notch. The two bottom notches may be U-shaped and may alternatively be described as slots. The top notch may form a gap in the V-channel that allows the end of the tie bar to slip under a shelf-support flange on a shelf-support beam during installation. The two bottom notches are sized and shaped to receive an upward facing retention flange located on the bottom flange of the shelf-support beam. A bottom notch is located in each leg of the V-channel. The bottom notches are formed at the same distance from the end of the tie-bar in each leg. The outward facing flanges on the legs of the tie bar may rest on the upward facing top of the bottom flange of the shelf-support beam. When installed, the upward facing base of the tie-bar may have the same elevation as the shelf-support flange. This allows the shelf medium (e.g., grating, steel plate) to lie flat across the tie bar and shelf-support flange. If the tie bar did not have the same elevation as the shelf-support flange, then the shelf medium would dip down from the support flange elevation to meet the tie bar or slope upward towards the tie bar and away from the support flange.

This combination of elements produces a number of advantages. The tie bar provides direct structural support for the shelf medium and helps connect the front and rear shelf beams. The tie bar helps prevents twisting of the front and rear beams that could result in otherwise (without the tie bars) excessive loading. The tri-notch assembly allows the tie bar to be installed at any position along the shelf-support beams. The shelf-support beam does not require slots or notches to be machined into the beam to receive the tie bar. This results in a more efficient manufacturing process and improved strength. The lack of slots or notches in the beams may improve the structural integrity of the beam by providing a structural web (the front face of the beam) with no or fewer penetrations. The lack of slots or notches in the beam may allow the same load to be carried with a thinner material or increase the loading capacity of the shelf beam, if the material thickness is not reduced. The tri-notch connection in the tie bar allows for installation without tools. The tri-notch connection is also more forgiving than a slot (located in the beam) and tab (located on the end of the tie bar) assembly found in existing shelving units.

As described in brief, an advantage of the technology described herein that the tie bar can be installed at any point along the horizontal shelf-support beam. Accordingly, openings in the horizontal shelf-support beam that mate with the tie bar and limit the installation of the tie bar to locations on the beam having the openings are inconsistent with the technology described herein. Accordingly, an improvement of the technology described herein is a horizontal shelf-support beam without openings that limit the installation location of the tie bar. The tri-notch system described herein enables a secure installation of the tie bar at any location along the horizontal shelf-support beam.

Having briefly described an overview of aspects of the technology described herein, an exemplary operating environment in which aspects of the technology described herein may be implemented is described below in order to provide a general context for various aspects.

Turning now to FIG. 1, a perspective view of a shelving unit 100 that includes the novel tie bar is provided. The shelving unit 100 comprises four vertical columns (110, 111, 112, and 113) located in each corner of the shelving unit 100. The four vertical columns include a back left column 110, a back right column 111, a front left column 112, and a front right column 113. The bottom of the vertical columns (110, 111, 112, and 113) rest on a floor or other support surface. The purpose of the vertical columns is to transfer a load on the shelves to the floor support surface. The four vertical columns (110, 111, 112, and 113) may be substantially identical and effectively interchangeable with each other. The interchangeability of the vertical columns means the location designations (e.g., front right, back left) given them in this description may be relative locations determined during assembly, rather than absolute locations.

The vertical columns (110, 111, 112, and 113) are shown as C-channels (alternatively described as U-channels). Embodiments of the technology described herein are not limited to vertical columns taking the form of a C channel. In alternative embodiments, the vertical columns may be tubular, L-beams, I-beams, or take some other suitable form. A face of the vertical columns (110, 111, 112, and 113) comprises apertures, which serve as a connection point for the horizontal shelf-support beams 130 and 131. Pins in the backside of the shelf-support beams may slide into the apertures. The apertures may likewise be used to attach bracing (120, 132, and 133), to the vertical columns (110, 111, 112, and 113). Other methods of attaching the bracing are possible. The bracing shown includes a diagonal brace 120, a top horizontal brace 132, and bottom horizontal brace 133.

The shelving unit 100 includes four shelves 160, 162, 164, 166. Each shelf comprises a front shelf-support beam 131 and a back shelf-support beam 130. One or more tie bars (140, 142, and 144) may run between the front shelf-support beam 131 and back shelf-support beam. Three tie bars are shown in FIG. 1, but embodiments are not limited to use with three tie bars. For example, one, two, three, four, five or more tie bars may be used. The tie bars (140, 142, and 144) can help support the shelf medium 150 and provide stability to the individual shelf and the overall shelving unit 100. In the embodiment shown, the shelf medium 150 is a grate. However, aspects the technology described herein are not limited to grating. Other type of shelf mediums, such as plywood, plastic, steel sheeting, and the like may be used. For sake of viewing the tie bars clearly, the second shelf 162 is shown without a shelf medium.

Figure 2:
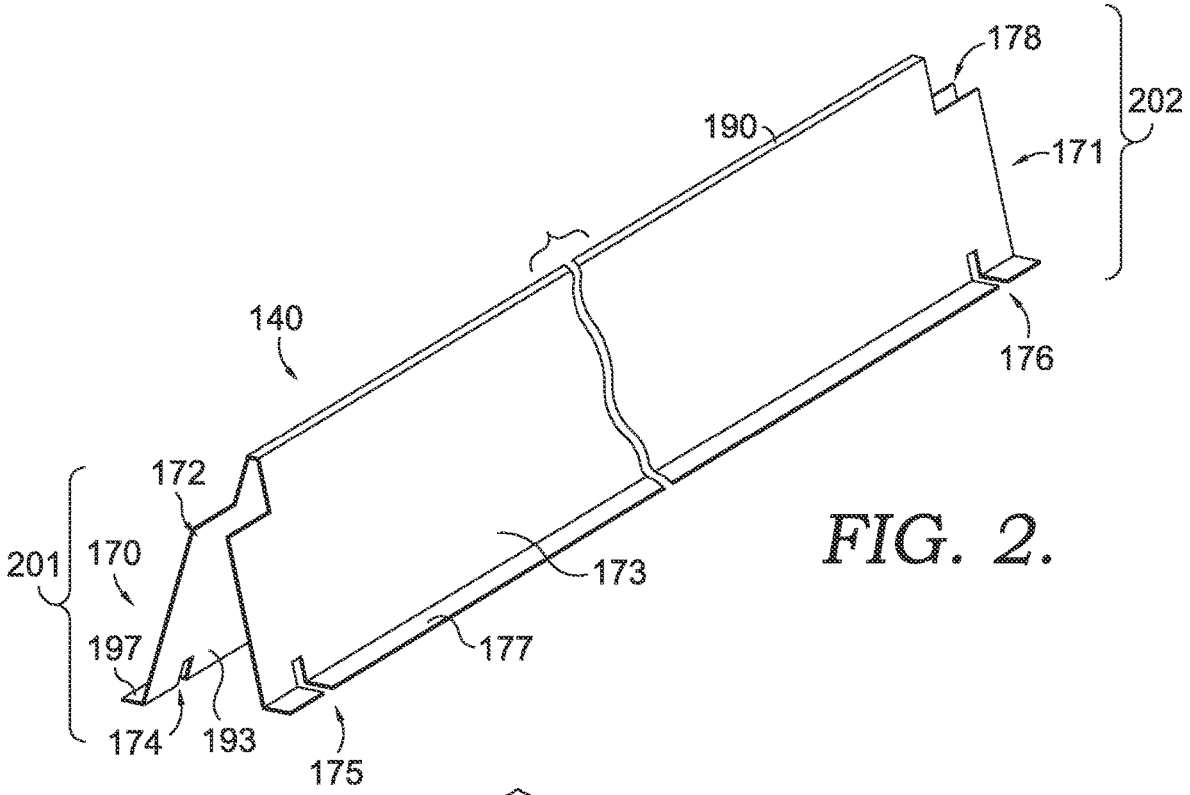
FIG. 2 is a perspective view of a tie bar, in accordance with aspects of the present disclosure.

Turning now to FIG. 2, a perspective view of a tie bar 140 is provided, in accordance with aspects of the present disclosure. The improved tie bar 140 may take the overall form of a V-channel with a novel tri-notch connection on the front end 170 and the back end 171. The tri-notch connection allows the tie bar 140 to connect with a front shelf-support beam on the front end 170 and a back shelf-support beam on the back end 171. The terms front and back describe the shelving unit from the perspective a person viewing the assembled shelving unit and may be relative. The terms front and back may be relative as the tie bar 140 may be reversible because there may be not visible or functional different between the front end 170 and back end 171.

When installed between support beams, the point of the V-channel is facing upward away from the floor. The open end of the V-channel faces downward. Rather than coming to a sharp point, the V-channel may have a flat bottom 190 for a shelf medium to rest upon. The width of the flat bottom 190 may be substantially smaller than the width of the opening of the V-channel. As used herein, a V-channel comprises two legs (173, 193) of substantially flat structural material (e.g., metal, aluminum) that come together at one end, either directly, or indirectly through use of a base member 190. The tie bar 140 may include outward facing flanges (177, 197) on the bottom-end (open end) of each leg (173, 193) of the V-channel. The outward facing flanges (177, 197) may be substantially parallel to the horizontal shelf-support beams.

The tie bar connects to the support beams through novel tri-notch connections (201, 202). The front tri-notch connection 201 includes two bottom notches (174 and 175) and a top notch 172. The back tri-notch connection 202 includes two bottom notches (176) (one of the bottom notches is not visible in FIG. 2) and a top notch 178. The bottom notches (174, 175, and 176) may be U-shaped and may alternatively be described as slots. A bottom notch is located in each leg of the V-channel. The bottom notches are formed at the same distance from the back end 171 and front end 172 of the tie bar 140 in each leg 173, 193.

Figure 3:
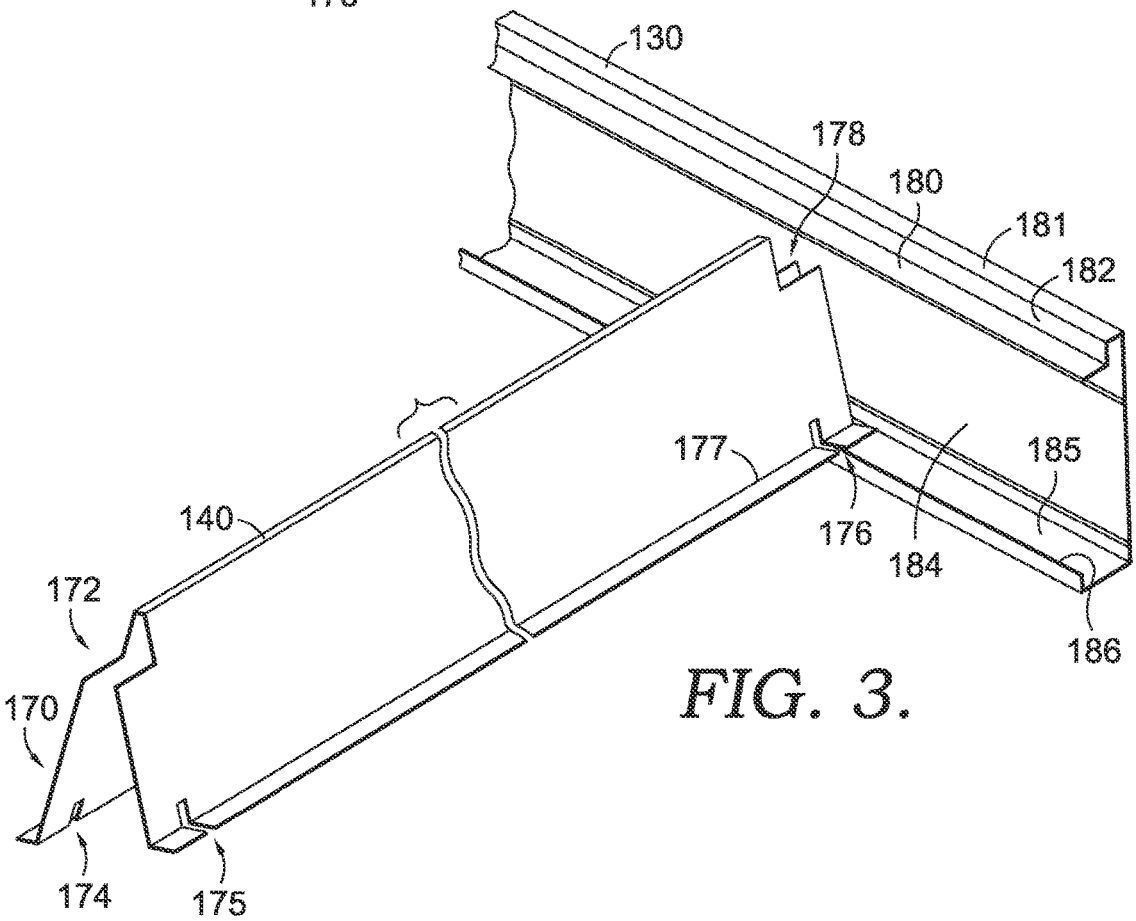
FIG. 3 is a perspective view of a tie bar installed on a shelf-support beam, in accordance with aspects of the present disclosure.

Turning now to FIG. 3, a perspective view of a tie bar 140 installed on a shelf-support beam 130 is provided, in accordance with aspects of the present disclosure. The top notch 178 may form a gap in top of the V-channel that allows the back end 171 of the tie bar 140 to slip under a shelf-support flange 180 on a shelf-support beam 130 during assembly. The bottom notches (174, 175, and 176) are sized and shaped to receive an upward facing retention flange 186 located on the bottom flange 185 of the shelf-support beam 130. The two bottom notches 176 (and unseen notch) are sized and shaped to receive the upward facing retention flange 186. The outward facing flanges 177, 197 on the tie bar 140 may rest on the upward facing top of the bottom flange 185 of the shelf-support beam 130. When installed, the upward facing base 140 of the tie-bar may have the same elevation as the shelf-support flange. This allows the shelf medium 150 (e.g., grating, steel plate) to lie flat across the tie bar 140 and shelf-support flange 180. If the tie bar 140 does not have the same elevation as the shelf-support flange 180, then the shelf medium 150 will dip down from the shelf-support flange 180 elevation to meet the tie bar 140 or slope upward towards the tie bar 140 and away from the shelf-support flange 180.

Figure 4A:
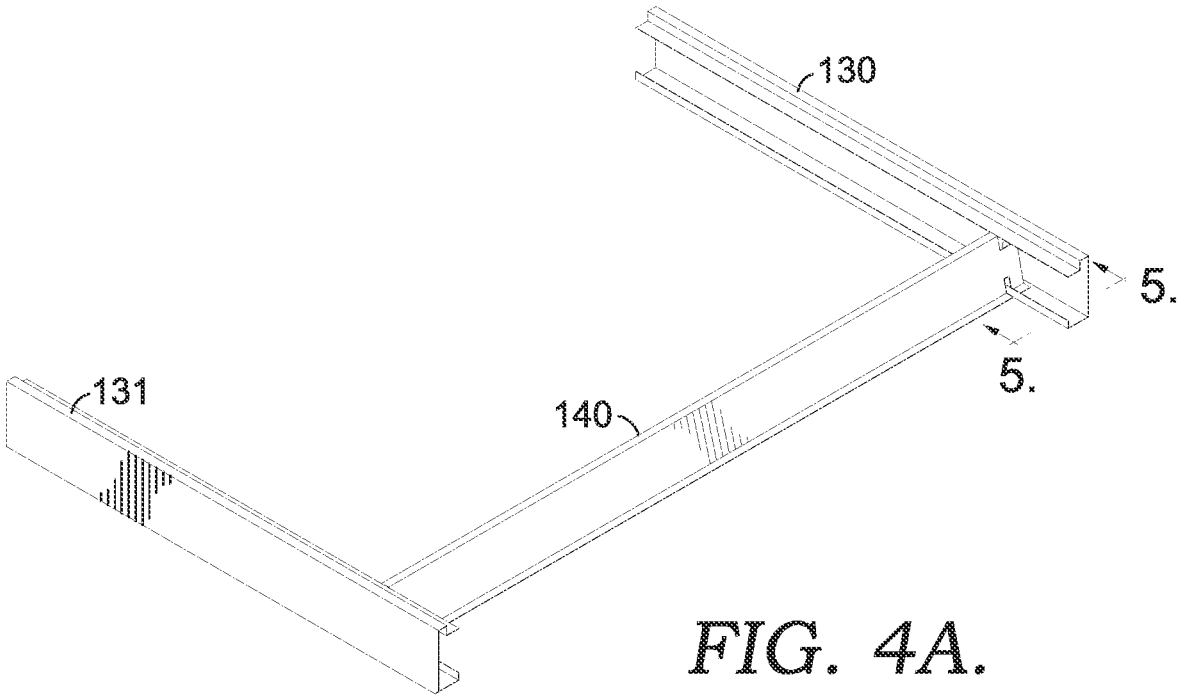
FIGS. 4*a*, 4*b*, and 4*c* depict the tie bar being uninstalled from the shelf-support beam, in accordance with aspects of the present disclosure.
Figure 4B:
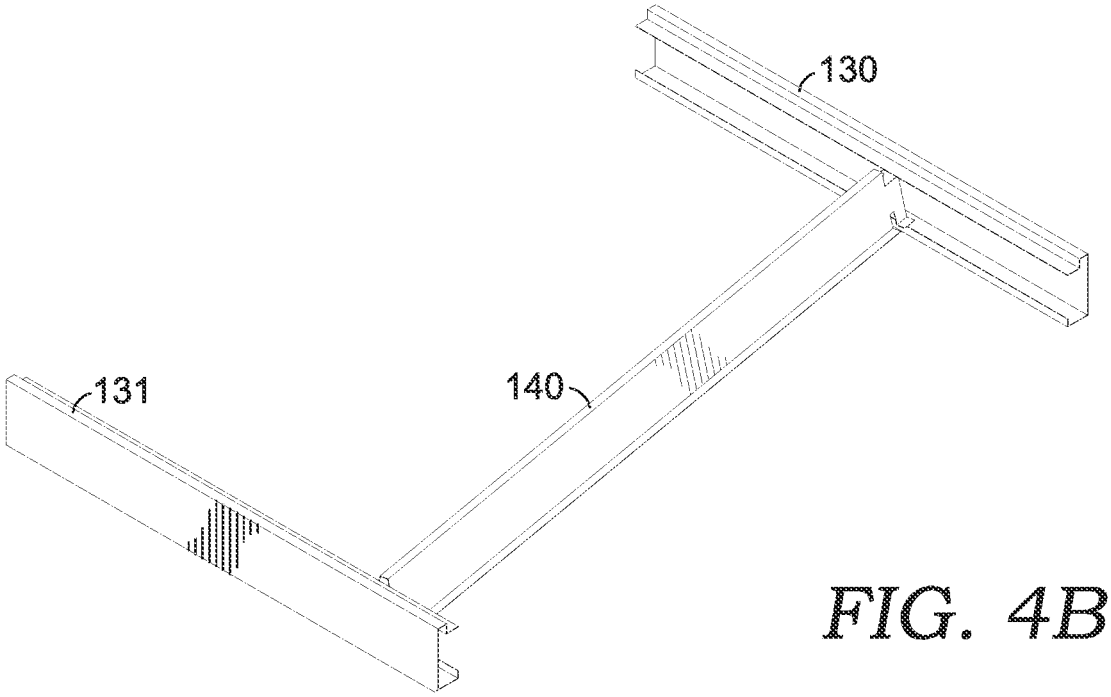
Figure 4C:
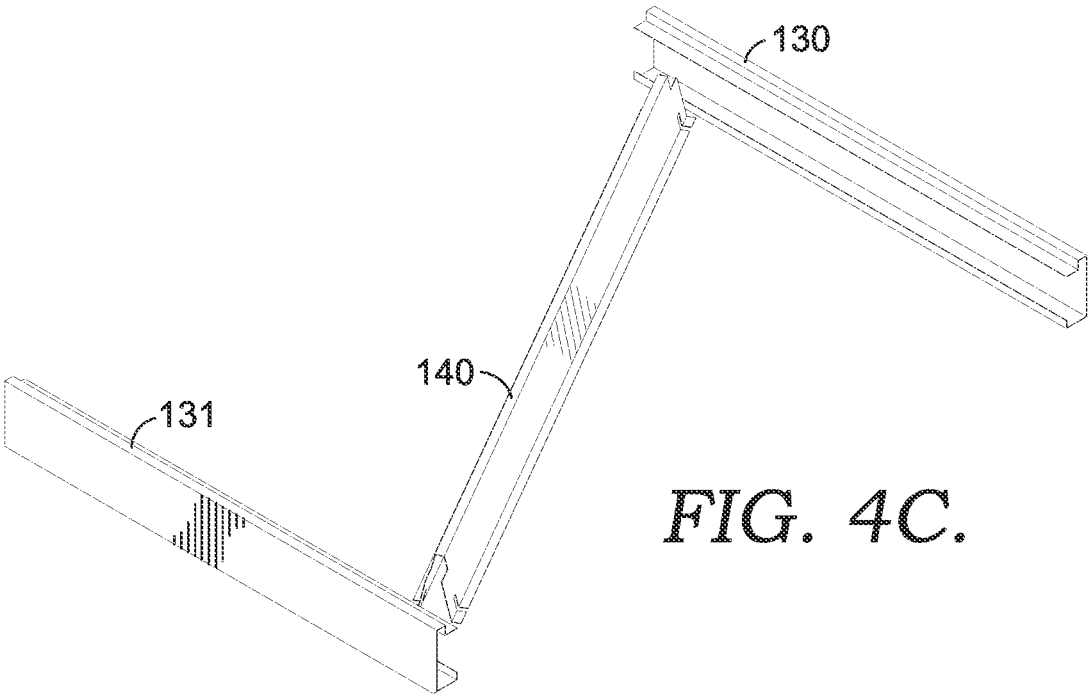

Turning now to FIGS. 4*a*, 4*b*, and 4*c* a depiction of the tie bar 140 being uninstalled from the shelf-support beam is provided, in accordance with aspects of the present disclosure. As can be seen in FIG. 4A, when installed, the tie bar 140 is perpendicular to the back shelf-support beam 130 and the front shelf-support beam 131. The three components are at roughly the same elevation. As previously explained, the top of the tie bar 140 may be substantially the same elevation as the shelf-support flange 180 on the shelf-support beam 130.

In FIG. 4B, the tie bar 140 is lifted upward to allow the bottom notches in the tri-notch connections to clear the upward facing retention flange 186 located on the bottom flange 185 of the shelf-support beam 130. Once the tie bar 140 is sufficiently raised, the tie bar 140 is rotated (as shown in FIG. 4C) until clear from the front shelf-support beam 131 and the back shelf-support beam 130, as shown in FIG. 4C. Installation of the tie bar 140 reverses the removal process. The tie bar 140 may be rotated into position using either a clockwise or a counter-clockwise motion.

Figure 5:
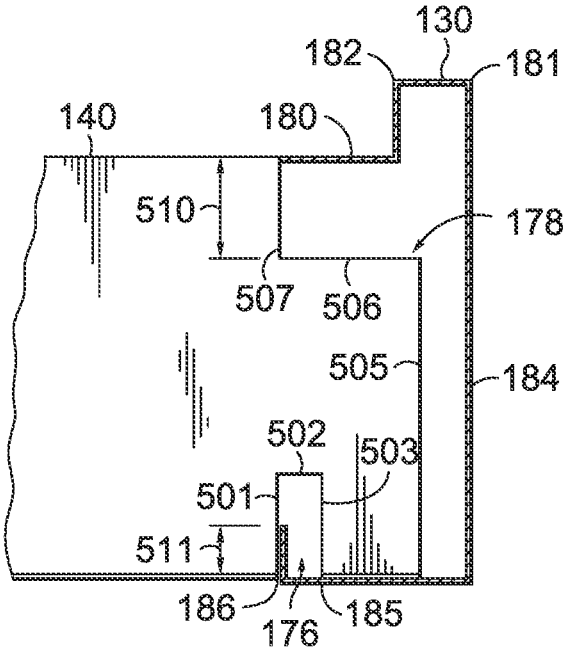
FIG. 5 is a cross section view of the tie bar installed on the shelf-support beam, in accordance with aspects of the present disclosure.

Turning now to FIG. 5, a cross section view of the tie bar 140 installed on the shelf-support beam 130 is provided, in accordance with aspects of the present disclosure. As can be seen, the bottom notch 176 is formed by an inner edge 501 that is parallel to an outer edge 503. A third edge forms the top 502 of the bottom notch 176. The height (length of edges 501 and 502) of the bottom notch 176 should be greater than the height of the retention flange 186. The back edge 505 of the tie bar 140 may be parallel to the webbing 184 of back shelf-support beam 130. The back shelf-support beam 130 also comprises a top flange 181 and a shelf retention wall 182, which keeps the shelf medium 150 from sliding backwards off the shelf-support flange 180.

The top notch 178 is bounded by a bottom horizontal edge 506 and an inner vertical edge 507. The top notch 178 forms a gap in both legs of the V-channel, as is also the case with the bottom notch 176 and its counterpart in the opposite side of the V-channel. The distance 510 between the bottom of the shelf-support flange 180 and the top of the bottom edge 506 should be greater than the height 511 of the bottom retention flange 186 to allow the tie bar 140 to be lifted over the bottom retention flange 186 during installation and/or removal. In embodiments, the top of the inner vertical edge 507 may be in contact with the end of the shelf-support flange 180. Similarly, the inner edge 501 may be in contact with the face of the retention flange 186. The shelf-support flange 180 and the bottom retention flange 186 may restrain the horizontal movement of the tie bar towards the webbing 184. In embodiments, the tight fit between the retention flange 185 and the corresponding notch edges (501 and 507) place the tie bar 140 in slight compression (essentially pinching the edges of the tie bar) in combination with the similar tri-notch connection on the other end of the tie bar 140 to hold the tie bar 140 in place.

In an embodiment, the tie bar 140 does not include a tab that is sized and shaped to mate with a slot in the horizontal shelf-support beam 130. In an embodiment, the horizontal shelf-support beam 130, including shelf-support flange 180 and webbing 184, does not include a slot or other opening sized and shaped to receive a tab in the tie bar 140 or any other portion of the tie bar 140. In an embodiment, the shelf-support flange 180 does not include any notches, slots, openings, or other apertures adapted to receive a portion of the tie bar 140. In other words, in an embodiment, the shelf-support flange 180 is solid from one end to the other end (e.g., running the length of the shelf-support flange 180 between vertical columns (110, 111, 112, and 113). As used herein, "solid" means without holes, slots, notches, or other openings adapted to receive any portion of the tie bar 140, such as a tab. The horizontal shelf-support beam 130, including shelf-support flange 180 and webbing 184, may be defined as solid even if it includes openings that are unrelated to use with the tie bar 140. For example, the horizontal shelf-support beam 130, including shelf-support flange 180 and webbing 184, may include openings used to attach it to the vertical columns (110, 111, 112, and 113). These openings for attaching the horizontal shelf-support beam 130 to the vertical columns (110, 111, 112, and 113) may be located on both ends and fall outside of the meaning of "from one end to the other end" and/or are otherwise excluded from the meaning of "solid." An advantage of the technology described herein that the tie bar 140 is able to be installed at any point along the horizontal shelf-support beam 130. Accordingly, openings in the horizontal shelf-support beam 130 that mate with the tie bar 140 and limit the installation of the tie bar 140 to locations on the beam 130 having the openings are inconsistent with the technology described herein. Accordingly, an improvement of the technology described herein is a horizontal shelf-support beam 130 without openings that limit the installation location of the tie bar 140.

The technology described herein has been described in relation to particular aspects, which are intended in all respects to be illustrative rather than restrictive. While the technology described herein is susceptible to various modifications and alternative constructions, certain illustrated aspects thereof are shown in the drawings and have been described above in detail. It should be understood, however, that there is no intention to limit the technology described herein to the specific forms disclosed, but on the contrary, the intention is to cover all modifications, alternative constructions, and equivalents falling within the spirit and scope of the technology described herein.

What is claimed is:

1. A shelving unit comprising: a front right column; a front left column; a back right column; and a back left column; and a Shelf comprising a front shelf-support beam removably connectable to the front right column and the front left column, a back shelf-support beam removably connectable to the back right column and the back left column, and a tie bar comprising a front end that has a first tri-notch connection removably connectable to the front shelf-support beam and a back end having a second tri-notch connection removably connectable to the back shelf-support beam, wherein the first and the second tri-notch connections each comprises a top notch that forms a void at a distal end of the tie bar, a first bottom notch, and a second bottom notch, wherein the first and second bottom notches each comprise an inner edge that is parallel to an outer edge, an enclosed top end, and an open bottom end at a bottom of the tie bar, wherein the front shelf-support beam does not include a slot, wherein the tie bar does not include a tab adapted to mate with a slot in the front shelf-support beam, wherein the front shelf-support beam comprises a shelf-support flange, a bottom flange, and an upward facing retention flange extending upwardly from the bottom flange, wherein the first bottom notch and the second bottom notch are sized and shaped to receive the upward facing retention flange of the front shelf-support beam, wherein the inner edge is in direct contact with a face of the upward facing retention flange when the tie bar is installed, and wherein the top notch is in direct contact with the shelf-support flange when the tie bar is installed.

2. The shelving unit of claim 1, wherein the tie bar is formed from a V-channel.

3. The shelving unit of claim 1, wherein the first and second bottom notches are U-shaped.

4. The shelving unit of claim 1, wherein the upward facing retention flange is solid from a first end to a second end.

5. A shelf for a shelving unit comprising:

a front shelf-support beam removably connectable to a back shelf-support beam with a tie bar having a first tri-notch connection on a front end and a second tri-notch connection on a back end, wherein the tie bar is formed from a V-channel, wherein the first tri-notch connection and the second tri-notch connection each comprises a top notch that forms a void at a distal end of the tie bar, a first bottom notch, and a second bottom notch, wherein the first and second bottom notches each comprise an inner edge that is parallel to an outer edge, an enclosed top end, and an open bottom end at a bottom of the tie bar, wherein the front shelf-support beam does not include a slot, wherein the tie bar does not include a tab adapted to mate with a slot in the front shelf-support beam, wherein the front shelf-support beam comprises a shelf-support flange, a bottom flange, and an upward facing retention flange extending upwardly from the bottom flange, wherein the first bottom notch and the second bottom notch are sized and shaped to receive the upward facing retention flange of the front shelf-support beam, wherein the inner edge is in direct contact with a face of the upward facing retention flange when the tie bar is installed, and wherein the top notch is in direct contact with the shelf-support flange when the tie bar is installed.

6. The shelf of claim 5, wherein an inner vertical edge of the first bottom notch is in contact with an inward facing face of the upward facing retention flange when the tie bar is installed.

7. The shelf of claim 5, wherein the upward facing retention flange is solid from one end to the other.

8. The shelf of claim 5, wherein the top notch is sized and shaped to fit under a shelf-support flange of the front shelf-support beam, wherein the shelf-support retention flange is solid from a first end to a second end.

9. The shelf of claim 5, wherein the first and second bottom notches are U-shaped.

10. The shelf of claim 5, wherein the top notch forms a gap in each leg of the V-channel.

11. A shelf for a shelving unit comprising:

a front shelf-support beam removably connectable to a back shelf-support beam with a tie bar having a first tri-notch connection on a front end and a second tri-notch connection on a back end, wherein the first tri-notch connection and the second tri-notch connection each comprises a top notch that forms a void at a distal end of the tie bar, a first bottom notch, and a second bottom notch, wherein the first and second bottom notches each comprise an inner edge that is parallel to an outer edge, an enclosed top end, and an open bottom end at a bottom of the tie bar, wherein the front shelf-support beam does not include a slot, wherein the tie bar does not include a tab adapted to mate with a slot in the front shelf-support beam, wherein the front shelf-support beam comprises a shelf-support flange, a bottom flange, and an upward facing retention flange extending upwardly from the bottom flange, wherein the first bottom notch and the second bottom notch are sized and shaped to receive the upward facing retention flange of the front shelf-support beam, wherein the inner edge is in direct contact with a face of the upward facing retention flange when the tie bar is installed, and wherein the top notch is in direct contact with the shelf-support flange when the tie bar is installed.

12. The shelf of claim 11, wherein the tie bar is formed from a V-channel.

13. The shelf of claim 12, wherein the top notch forms a gap in each leg of the V-channel.

14. The shelf of claim 13, wherein the top notch is bounded by a bottom horizontal edge and an inner vertical edge in both legs of the V-channel.

15. The shelf of claim 11, wherein an inner vertical edge of the first bottom notch is in contact with an inward facing face of the upward facing retention flange when the tie bar is installed.

16. The shelf of claim 11, wherein the upward facing retention flange is solid from one end to the other.

17. The shelf of claim 11, wherein the front shelf-support beam further comprises a shelf-support flange; and wherein the top notch is sized and shaped to fit under the shelf-support flange of the front shelf-support beam, wherein the shelf-support flange is solid from a first end to a second end.

18. The shelf of claim 11, wherein the three edges forming the enclosed top end and the open bottom end of the first and second bottom notches comprises an inner edge that is parallel to an outer edge.

19. The shelf of claim 18, wherein the inner edge is in contact with a face of the upward facing retention flange.

20. The shelf of claim 11, wherein the first and second bottom notches are U-shaped.

* * * * *